US008436799B2

(12) United States Patent
Credelle

(10) Patent No.: US 8,436,799 B2
(45) Date of Patent: May 7, 2013

(54) IMAGE DEGRADATION CORRECTION IN NOVEL LIQUID CRYSTAL DISPLAYS WITH SPLIT BLUE SUBPIXELS

(75) Inventor: Thomas Lloyd Credelle, Morgan Hill, CA (US)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 10/696,236

(22) Filed: Oct. 28, 2003

(65) Prior Publication Data

US 2005/0083277 A1 Apr. 21, 2005

Related U.S. Application Data

(63) Continuation-in-part of application No. 10/456,839, filed on Jun. 6, 2003, now abandoned.

(51) Int. Cl.
*G09G 3/36* (2006.01)

(52) U.S. Cl.
USPC ..... 345/96; 345/209

(58) Field of Classification Search ..... 345/96, 345/88, 209
See application file for complete search history.

(56) References Cited

U.S. PATENT DOCUMENTS

| | | | |
|---|---|---|---|
| 3,971,065 | A | 7/1976 | Bayer |
| 4,353,062 | A | 10/1982 | Lorteije et al. |
| 4,642,619 | A | 2/1987 | Togashi |
| 4,651,148 | A | 3/1987 | Takeda et al. |
| 4,773,737 | A | 9/1988 | Yokono et al. |
| 4,781,438 | A | 11/1988 | Noguchi |
| 4,800,375 | A | 1/1989 | Silverstein et al. |
| 4,853,592 | A | 8/1989 | Stratham |
| 4,874,986 | A | 10/1989 | Menn et al. |
| 4,886,343 | A | 12/1989 | Johnson |
| 4,908,609 | A | 3/1990 | Stroomer |
| 4,920,409 | A | 4/1990 | Yamagishi |
| 4,965,565 | A | 10/1990 | Noguchi |
| 5,006,840 | A | 4/1991 | Hamada et al. |
| 5,052,785 | A | 10/1991 | Takimoto et al. |
| 5,097,297 | A | 3/1992 | Nakazawa |
| 5,113,274 | A | 5/1992 | Takahashi et al. |
| 5,144,288 | A | 9/1992 | Hamada et al. |
| 5,184,114 | A | 2/1993 | Brown |
| 5,191,451 | A | 3/1993 | Katayama et al. |
| 5,196,924 | A | 3/1993 | Lumelsky et al. |

(Continued)

FOREIGN PATENT DOCUMENTS

| | | |
|---|---|---|
| DE | 299 09 537 U1 | 10/1999 |
| DE | 199 23 527 | 11/2000 |

(Continued)

OTHER PUBLICATIONS

PCT International Search Report dated Dec. 9, 2005 for PCT/US04/18034 (U.S. Appl. No. 10/455,925).

(Continued)

*Primary Examiner* — Seokyun Moon
(74) *Attorney, Agent, or Firm* — Innovation Counsel LLP

(57) ABSTRACT

Systems and methods are disclosed to correct for image degraded signals on a liquid crystal display panel are disclosed. Panels that comprise a subpixel repeating group having an even number of subpixels in a first direction may have parasitic capacitance and other signal errors due to imperfect dot inversion schemes thereon. Techniques for signal correction and localizing of errors onto particular subpixels are disclosed.

25 Claims, 8 Drawing Sheets

U.S. PATENT DOCUMENTS 5,311,205 A 5/1994 Hamada et al.
5,311,337 A 5/1994 McCartney, Jr.
5,315,418 A 5/1994 Sprague et al.
5,334,996 A 8/1994 Tanigaki et al.
5,341,153 A 8/1994 Benzschawel et al.
5,398,066 A 3/1995 Martinez-Uriegas et al.
5,436,747 A 7/1995 Suzuki
5,438,649 A 8/1995 Ruetz
5,448,652 A 9/1995 Vaidyanathan et al.
5,450,216 A 9/1995 Kasson
5,459,595 A 10/1995 Ishiguro
5,461,503 A 10/1995 Deffontaines et al.
5,485,293 A * 1/1996 Robinder ..... 345/88
5,535,028 A 7/1996 Bae et al.
5,563,621 A 10/1996 Silsby
5,579,027 A 11/1996 Sakurai et al.
5,646,702 A 7/1997 Akinwande et al.
5,648,793 A 7/1997 Chen
5,739,802 A 4/1998 Mosier
5,754,163 A 5/1998 Kwon
5,754,226 A 5/1998 Yamada et al.
5,767,829 A 6/1998 Verhulst
5,808,594 A 9/1998 Tsubyama et al.
5,818,405 A 10/1998 Eglit et al.
5,841,411 A * 11/1998 Francis ..... 345/58
5,877,512 A 3/1999 Kim
5,899,550 A 5/1999 Masaki
5,949,396 A 9/1999 Lee
5,949,496 A 9/1999 Kim
5,971,546 A 10/1999 Park
6,005,692 A 12/1999 Stahl
6,008,868 A 12/1999 Silverbrook
6,037,719 A 3/2000 Yap et al.
6,064,363 A 5/2000 Kwon
6,069,670 A 5/2000 Borer
6,088,050 A 7/2000 Ng
6,097,367 A 8/2000 Kuriwaki et al.
6,100,872 A 8/2000 Aratani et al.
6,108,122 A 8/2000 Ulrich et al.
6,115,092 A 9/2000 Greene et al.
6,144,352 A 11/2000 Matsuda et al.
6,147,664 A 11/2000 Hansen
6,151,001 A 11/2000 Anderson et al.
6,160,535 A 12/2000 Park
6,188,385 B1 2/2001 Hill et al.
6,219,019 B1 4/2001 Hasegawa
6,219,025 B1 4/2001 Hill et al.
6,225,967 B1 5/2001 Hebiguchi
6,225,973 B1 5/2001 Hill et al.
6,236,390 B1 5/2001 Hitchcock
6,239,783 B1 5/2001 Hill et al.
6,243,055 B1 6/2001 Fergason
6,243,070 B1 6/2001 Hill et al.
6,278,434 B1 8/2001 Hill et al.
6,326,981 B1 * 12/2001 Mori et al. ..... 345/695
6,327,008 B1 12/2001 Fujiyoshi
6,332,030 B1 12/2001 Manjunath et al.
6,335,719 B1 1/2002 An et al.
6,342,876 B1 1/2002 Kim
6,348,929 B1 2/2002 Acharya et al.
6,377,262 B1 4/2002 Hitchcock et al.
6,388,644 B1 5/2002 De Zwart et al.
6,392,717 B1 5/2002 Kunzman
6,393,145 B2 5/2002 Betrisey et al.
6,396,505 B1 5/2002 Lui et al.
6,441,867 B1 8/2002 Daly
6,469,766 B2 10/2002 Waterman et al.
6,545,653 B1 4/2003 Takahara et al.
6,552,706 B1 * 4/2003 Ikeda et al. ..... 345/96
6,570,584 B1 5/2003 Cok et al.
6,590,555 B2 7/2003 Su et al.
6,624,828 B1 9/2003 Dresevic et al.
6,661,429 B1 12/2003 Phan
6,674,430 B1 1/2004 Kaufman et al.
6,674,436 B1 1/2004 Dresevic et al.
6,680,761 B1 1/2004 Greene et al.
6,714,206 B1 * 3/2004 Martin et al. ..... 345/589
6,714,212 B1 3/2004 Tsuboyama et al.
6,714,243 B1 3/2004 Mathur et al.
6,727,878 B2 * 4/2004 Okuzono et al. ..... 345/96
6,738,204 B1 5/2004 Chuang et al.
6,750,875 B1 6/2004 Keely, Jr. et al.
6,771,028 B1 8/2004 Winters
6,804,407 B2 10/2004 Weldy
6,833,888 B2 12/2004 Song et al.
6,833,890 B2 12/2004 Hong et al.
6,836,300 B2 12/2004 Choo et al.
6,850,294 B2 2/2005 Roh et al.
6,867,549 B2 3/2005 Cok et al.
6,885,380 B1 4/2005 Primerano et al.
6,888,604 B2 5/2005 Rho et al.
6,897,876 B2 5/2005 Murdoch et al.
6,903,378 B2 6/2005 Cok
6,995,346 B2 2/2006 Johanneson et al.
7,151,518 B2 12/2006 Fukumoto
7,187,353 B2 3/2007 Credelle et al.
7,209,105 B2 4/2007 Elliott
7,218,301 B2 5/2007 Credelle
7,259,755 B1 * 8/2007 Ahn ..... 345/204
2001/0015716 A1 8/2001 Kim
2001/0017607 A1 8/2001 Kwon et al.
2001/0052897 A1 * 12/2001 Nakano et al. ..... 345/204
2002/0015110 A1 2/2002 Brown Elliott
2002/0093476 A1 7/2002 Hill et al.
2002/0158997 A1 10/2002 Fukami et al.
2003/0006978 A1 1/2003 Fujiyoshi
2003/0011603 A1 1/2003 Koyama et al.
2003/0016310 A1 1/2003 Lee et al.
2003/0048248 A1 3/2003 Fukumoto et al.
2003/0071943 A1 4/2003 Choo et al.
2003/0077000 A1 4/2003 Blinn et al.
2003/0090581 A1 5/2003 Credelle et al.
2003/0128179 A1 7/2003 Credelle
2003/0146893 A1 8/2003 Sawabe
2003/0189537 A1 10/2003 Yun
2003/0218618 A1 11/2003 Phan
2004/0008208 A1 1/2004 Dresevic et al.
2004/0021804 A1 2/2004 Hong et al.
2004/0046725 A1 3/2004 Lee
2004/0061710 A1 4/2004 Messing et al.
2004/0094766 A1 5/2004 Lee et al.
2004/0095521 A1 5/2004 Song et al.
2004/0104873 A1 6/2004 Kang et al.
2004/0114046 A1 6/2004 Lee et al.
2004/0150651 A1 8/2004 Phan
2004/0155895 A1 8/2004 Lai
2004/0169807 A1 9/2004 Rho et al.
2004/0174389 A1 9/2004 Ben-David et al.
2004/0179160 A1 9/2004 Rhee et al.
2004/0189662 A1 9/2004 Frisken et al.
2004/0189664 A1 9/2004 Frisken et al.
2004/0213449 A1 10/2004 Safee-Rad et al.
2004/0223005 A1 11/2004 Lee
2004/0239813 A1 12/2004 Klompenhouwer
2004/0239837 A1 12/2004 Hong et al.
2004/0246213 A1 12/2004 Credelle et al.
2004/0246278 A1 12/2004 Elliott
2004/0246279 A1 12/2004 Credelle et al.
2004/0246280 A1 12/2004 Credelle et al.
2004/0246381 A1 12/2004 Credelle
2004/0246404 A1 12/2004 Elliott et al.
2004/0247070 A1 12/2004 Ali et al.
2005/0007539 A1 1/2005 Taguchi et al.
2005/0024380 A1 2/2005 Lin et al.
2005/0040760 A1 2/2005 Taguchi et al.
2005/0068477 A1 3/2005 Shin et al.
2005/0083277 A1 4/2005 Credelle
2005/0083356 A1 4/2005 Roh et al.
2005/0140634 A1 6/2005 Takatori
2005/0151752 A1 7/2005 Phan
2005/0162600 A1 7/2005 Rho et al.
2005/0219274 A1 10/2005 Yang et al.

FOREIGN PATENT DOCUMENTS

DE 201 09 354 U1 9/2001
EP 0 322 106 A2 6/1989
EP 1 381 020 A2 1/2004

| | | | |
|---|---|---|---|
| JP | 60-107022 | | 6/1985 |
| JP | 02-000826 | A | 1/1990 |
| JP | 02-983027 | B2 | 4/1991 |
| JP | 03-78390 | | 4/1991 |
| JP | 06-102503 | | 4/1994 |
| JP | 08-202317 | | 8/1996 |
| JP | 11-282008 | | 10/1999 |
| JP | 2000-330084 | A | 11/2000 |
| JP | 2001-033757 | A | 2/2001 |
| JP | 2002-236466 | A | 8/2002 |
| JP | 2004-004822 | | 1/2004 |
| JP | 2005-208580 | A | 8/2005 |
| WO | WO 2004/021323 | A2 | 3/2004 |
| WO | WO 2004/027503 | A1 | 4/2004 |
| WO | WO 2004/086128 | A1 | 10/2004 |
| WO | WO 2005/050296 | A1 | 6/2005 |

OTHER PUBLICATIONS

PCT International Search Report dated Feb. 1, 2006 for PCT/US04/18038 (U.S. Appl. No. 10/455,931).
PCT International Search Report dated Mar. 15, 2006 for PCT/US04/18033 (U.S. Appl. No. 10/455,927).
PCT International Search Report dated Jan. 10, 2006 for PCT/US04/18035 (U.S. Appl. No. 10/456,806).
PCT International Search Report dated Sep. 24, 2004 for PCT/US04/17796 (U.S. Appl. No. 10/456,838).
PCT International Search Report dated Nov. 3, 2004 for PCT/US04/18036 (U.S. Appl. No. 10/696,236).
USPTO, Non-Final Office Action, dated Mar. 9, 2004 in US Patent No. 6,903,754 (U.S. Appl. No. 09/916,232).
USPTO, Non-Final Office Action, dated May 6, 2004 in US Patent No. 6,903,754 (U.S. Appl. No. 09/916,232).
Clairvoyante Inc., Response to Non-Final Office Action, dated Sep. 3, 2004 in US Patent No. 6,903,754 (U.S. Appl. No. 09/916,232).
USPTO, Final Office Action, dated Jan. 6, 2005 in US Patent No. 6,903,754 (U.S. Appl. No. 09/916,232).
Clairvoyante Inc., Response to Final Office Action, dated Jan. 28, 2005 in US Patent No. 6,903,754 (U.S. Appl. No. 09/916,232).
USPTO, Notice of Allowance, dated Feb. 7, 2005 in U.S. Appl. No. 6,903,754 (U.S. Appl. No. 09/916,232).
USPTO, Non-Final Office Action, dated Nov. 16, 2004 in US Patent Publication No. 2003/0128179, (U.S. Appl. No. 10/278,352).
Clairvoyante Inc, Response to Non-Final Office Action, dated Apr. 15, 2005 in US Patent Publication No. 2003/0128179, (U.S. Appl. No. 10/278,352).
USPTO, Non-Final Office Action, dated Jul. 12, 2005 in US Patent Publication No. 2003/0128179, (U.S. Appl. No. 10/278,352).
Clairvoyante Inc, Response to Non-Final Office Action, dated Jan. 12, 2006 in US Patent Publication No. 2003/0128179, (U.S. Appl. No. 10/278,352).
USPTO, Final Office Action, dated Sep. 18, 2006 in US Patent Publication No. 2003/0128179, (U.S. Appl. No. 10/278,352).
Clairvoyante Inc, Response to Final Office Action, dated Dec. 6, 2006 in US Patent Publication No. 2003/0128179, (U.S. Appl. No. 10/278,352).
Clairvoyante, Inc, Repsonse to Non-Final Office Action dated Nov. 10, 2006 in US Patent Publication No. 2004/0246213 (U.S. Appl. No. 10/455,925).
USPTO, Final Office Action dated Feb. 14, 2007 in US Patent Publication No. 2004/0246213 (U.S. Appl. No. 10/455,925).
Clairvoyante Inc, Response to Non-Final Office Action dated Oct. 2, 2006 in US Patent Publication No. 2004/0246381 (U.S. Appl. No. 10/455,931).
USPTO, Final Office Action dated Aug. 9, 2006 in US Patent Publication No. 2004/0246278 (U.S. Appl. No. 10/455,927).
Clairvoyante Inc, Response to Non-Final Office Action dated Nov. 20, 2006 in US Patent Publication No. 2004/0246278 (U.S. Appl. No. 10/455,927).
Clairvoyante Inc, Response to Non-Final Office Action dated Feb. 21, 2006 in US Patent Publication No. 2004/0246279 (U.S. Appl. No. 10/456,806).
Clairvoyante Inc, Response to Final Office Action dated Aug. 2, 2006 in US Patent Publication No. 2004/0246279 (U.S. Appl. No. 10/456,806).
USPTO, Notice of Allowance, dated Sep. 18, 2006 in US Patent Publication No. 2004/0246279 (U.S. Appl. No. 10/456,806).
Clairvoyante Inc, Response to Non-Final Office Action dated Sep. 14, 2006 in US Patent Publication No. 2004/0246404 (U.S. Appl. No. 10/456,838).
USPTO, Final Office Action dated Jan. 18, 2007 in US Patent Publication No. 2004/0246404 (U.S. Appl. No. 10/456,838).
USPTO, Final Office Action dated Aug. 29, 2006 in US Patent Publication No. 2004/0246280 (U.S. Appl. No. 10/456,839).
Clairvoyante Inc, Response to Final Office Action dated Feb. 21, 2007 in US Patent Publication No. 2004/0246280 (U.S. Appl. No. 10/456,839).
USPTO, Non-Final Office Action, dated Jun. 27, 2007 in US Patent Publication No. 2003/0128179, (U.S. Appl. No. 10/278,352).
Clairvoyante Inc, Response to Non-Final Office Action, dated Dec. 27, 2007 in US Patent Publication No. 2003/0128179, (U.S. Appl. No. 10/278,352).
Clairvoyante, Inc, Response to Non-Final Office Action dated Jul. 13, 2007 in US Patent Publication No. 2004/0246213 (U.S. Appl. No. 10/455,925).
USPTO, Final Office Action dated Aug. 30, 2007 in US Patent Publication No. 2004/0246213 (U.S. Appl. No. 10/455,925).
Clairvoyante Inc, Response to Non-Final Office Action dated Feb. 21, 2005 in US Patent No. 7,187,353 (U.S. Appl. No. 10/456,806).
Clairvoyante Inc, Response to Final Office Action dated Jun. 18, 2007 in US Patent Publication No. 2004/0246404 (U.S. Appl. No. 10/456,838).
USPTO, Non-Final Office Action dated Jul. 27, 2007 in US Patent Publication No. 2004/0246404 (U.S. Appl. No. 10/456,838).
Clairvoyante Inc, Response to Non-Final Office Action dated Jan. 28, 2008 in US Patent Publication No. 2004/0246404 (U.S. Appl. No. 10/456,838).
USPTO, Non-Final Office Action dated May 16, 2007 in US Patent Publication No. 2004/0246280 (U.S. Appl. No. 10/456,839).
European Search Report, corresponding to EP 10185588.0, dated Apr. 21, 2011, 6 pages.
Brown Elliott, C., "Active Matrix Display . . . ", IDMC 2000, 185-189, Aug. 2000.
Brown Elliott, C., "Color Subpixel Rendering Projectors and Flat Panel Displays," SMPTE, Feb. 27-Mar. 1, 2003, Seattle, WA pp. 1-4.
Brown Elliott, C, "Co-Optimization of Color AMLCD Subpixel Architecture and Rendering Algorithms," SID 2002 Proceedings Paper, May 30, 2002 pp. 172-175.
Brown Elliott, C, "Development of the PenTile Matrix™ Color AMLCD Subpixel Architecture and Rendering Algorithms", SID 2003, Journal Article.
Brown Elliott, C, "New Pixel Layout for PenTile Matrix™ Architecture", IDMC 2002, pp. 115-117.
Brown Elliott, C, "Pentile Matirx™ Displays and Drivers" ADEAC Proceedings Paper, Portland OR., Oct. 2005.
Brown Elliott, C, "Reducing Pixel Count Without Reducing Image Quality", Information Display Dec. 1999, vol. 1, pp. 22-25.
Credelle, Thomas, "P-00: MTF of High-Resolution PenTile Matrix Displays", Eurodisplay 02 Digest, 2002 pp. 1-4.
Daly, Scott, "Analysis of Subtriad Addressing Algorithms by Visual System Models",SID Symp. Digest, Jun. 2001 pp. 1200-1203.
Klompenhouwer, Michiel, Subpixel Image Scaling for Color Matrix Displays, SID Symp. Digest, May 2002, pp. 176-179.
Krantz, John et al., Color Matrix Display Image Quality: The Effects of Luminance . . . SID 90 Digest, 1990, pp. 29-32.
Lee, Baek-woon et al., 40.5L: Late-News Paper: TFT-LCD with RGBW Color system, SID 03 Digest, 2003, pp. 1212-1215.
Messing, Dean et al., Improved Display Resolution of Subsampled Colour Images Using Subpixel Addressing, IEEE ICIP 2002, vol. 1, pp. 625-628.
Messing, Dean et al., Subpixel Rendering on Non-Striped Colour Matrix Displays, 2003 International Conf on Image Processing, Sep. 2003, Barcelona, Spain, 4 pages.
Okumura et al., "A New Flicker-Reduction Drive Method for High Resolution LCTVs", SID Digest,pp. 551-554, 2001.

UPSTO, Non-Final Office Action dated Oct. 26, 2005 in US Patent Publication No. 2004/0246213 (U.S. Appl. No. 10/455,925).
Clairvoyante, Inc, Repsonse to Non-Final Office Action dated Apr. 26, 2006 in US Patent Publication No. 2004/0246213 (U.S. Appl. No. 10/455,925).
UPSTO, Final Office Action dated Jun. 14, 2006 in US Patent Publication No. 2004/0246213 (U.S. Appl. No. 10/455,925).
UPSTO, Non-Final Office Action dated Oct. 19, 2004 in US Patent Publication No. 2004/0246381 (U.S. Appl. No. 10/455,931).
Clairvoyante Inc, Response to Non-Final Office Action dated Jan. 18, 2005 in US Patent Publication No. 2004/0246381 (U.S. Appl. No. 10/455,931).
USPTO, Final Office Action dated Jul. 12, 2005 in US Patent Publication No. 2004/0246381 (U.S. Appl. No. 10/455,931).
Clairvoyante Inc, Response to Final Office Action dated Jan. 12, 2006 in US Patent Publication No. 2004/0246381 (U.S. Appl. No. 10/455,931).
UPSTO, Non-Final Office Action dated May 1, 2006 in US Patent Publication No. 2004/0246381 (U.S. Appl. No. 10/455,931).
UPSTO, Non-Final Office Action dated Jan. 23, 2006 in US Patent Publication No. 2004/0246278 (U.S. Appl. No. 10/455,927).
Clairvoyante Inc, Response to Non-Final Office Action dated May 19, 2006 in US Patent Publication No. 2004/0246278 (U.S. Appl. No. 10/455,927).
UPSTO, Non-Final Office Action dated Oct. 19, 2005 in US Patent Publication No. 2004/0246279 (U.S. Appl. No. 10/456,806).
UPSTO, Final Office Action dated May 2, 2006 in US Patent Publication No. 2004/0246279 (U.S. Appl. No. 10/456,806).
UPSTO, Non-Final Office Action dated Sep. 2, 2004 in US Patent Publication No. 2004/0246404 (U.S. Appl. No. 10/456,838).
Clairvoyante Inc, Response to Non-Final Office Action dated Jan. 28, 2005 in US Patent Publication No. 2004/0246404 (U.S. Appl. No. 10/456,838).
UPSTO, Final Office Action dated Jun. 9, 2005 in US Patent Publication No. 2004/0246404 (U.S. Appl. No. 10/456,838).
Clairvoyante Inc, Response to Final Office Action dated Dec. 5, 2005 in US Patent Publication No. 2004/0246404 (U.S. Appl. No. 10/456,838).
UPSTO, Non-Final Office Action dated Mar. 20, 2006 in US Patent Publication No. 2004/0246404 (U.S. Appl. No. 10/456,838).
UPSTO, Non-Final Office Action dated Mar. 20, 2006 in US Patent Publication No. 2004/0246280 (U.S. Appl. No. 10/456,839).
Clairvoyante Inc, Response to Non-Final Office Action dated Jun. 20, 2006 in US Patent Publication No. 2004/0246280 (U.S. Appl. No. 10/456,839).

* cited by examiner

| | 301A | 301B | 301C | 301D | |
|---|---|---|---|---|---|
| 1 | + - | - + | - + | + - | • • • • |
| 2 | - + | - + | + - | + - | • • • • |
| 3 | - + | + - | + - | - + | • • • • |
| 4 | + - | + - | - + | - + | • • • • |

FIG. 4

IMAGE DEGRADATION CORRECTION IN NOVEL LIQUID CRYSTAL DISPLAYS WITH SPLIT BLUE SUBPIXELS

RELATED APPLICATIONS

This application is a continuation-in-part application of U.S. patent application Ser. No. 10/456,839 entitled "IMAGE DEGRADATION CORRECTION IN NOVEL LIQUID CRYSTAL DISPLAYS" filed on Jun. 6, 2003, now abandoned herein incorporated by reference in its entirety, and claims benefit of the priority date thereof.

The present application is related to commonly owned United States Patent Applications: (1) U.S. patent application Ser. No. 10/455,925 entitled "DISPLAY PANEL HAVING CROSSOVER CONNECTIONS EFFECTING DOT INVERSION", filed on Jun. 6, 2003, and published as US Patent Application Publication 2004/0246213; (2) U.S. patent application Ser. No. 10/455,931 entitled "SYSTEM AND METHOD OF PERFORMING DOT INVERSION WITH STANDARD DRIVERS AND BACKPLANE ON NOVEL DISPLAY PANEL LAYOUTS", filed on Jun. 6, 2003, and published as US Patent Application Publication 2004/0246381; (3) U.S. patent application Ser. No. 10/455,927 entitled "SYSTEM AND METHOD FOR COMPENSATING FOR VISUAL EFFECTS UPON PANELS HAVING FIXED PATTERN NOISE WITH REDUCED QUANTIZATION ERROR", filed on Jun. 6, 2003, and published as US Patent Application Publication 2004/0246278; (4) U.S. patent application Ser. No. 10/456,806 entitled "DOT INVERSION ON NOVEL DISPLAY PANEL LAYOUTS WITH EXTRA DRIVERS", filed on Jun. 6, 2003, and published as US Patent Application Publication 2004/0246279; and (5) U.S. patent application Ser. No. 10/456,838 entitled "LIQUID CRYSTAL DISPLAY BACKPLANE LAYOUTS AND ADDRESSING FOR NON-STANDARD SUBPIXEL ARRANGEMENTS," and published as US Patent Application Publication 2004/0246404, which are hereby incorporated herein by reference in their entirety.

BACKGROUND

In commonly owned United States Patent Applications: (1) U.S. patent application Ser. No. 09/916,232, entitled "ARRANGEMENT OF COLOR PIXELS FOR FULL COLOR IMAGING DEVICES WITH SIMPLIFIED ADDRESSING," filed Jul. 25, 2001, and issued as U.S. Pat. No. 6,903,754 ("the '754 patent"); (2) U.S. patent application Ser. No. 10/278,353 entitled "IMPROVEMENTS TO COLOR FLAT PANEL DISPLAY SUB-PIXEL ARRANGEMENTS AND LAYOUTS FOR SUB-PIXEL RENDERING WITH INCREASED MODULATION TRANSFER FUNCTION RESPONSE," filed Oct. 22, 2002, and published as US Patent Application Publication 2003/0128225 ("the '225 application"); (3) U.S. patent application Ser. No. 10/278,352 entitled "IMPROVEMENTS TO COLOR FLAT PANEL DISPLAY SUB-PIXEL ARRANGEMENTS AND LAYOUTS FOR SUB-PIXEL RENDERING WITH SPLIT BLUE SUB-PIXELS," filed Oct. 22, 2002, and published as US Patent Application Publication 2003/0128179 ("the '179 application"); (4) U.S. patent application Ser. No. 10/243,094 entitled "IMPROVED FOUR COLOR ARRANGEMENTS AND EMITTERS FOR SUB-PIXEL RENDERING," filed Sep. 13, 2002, and published as US Patent Application Publication 2004/0051724 ("the '724 application"); (5) U.S. patent application Ser. No. 10/278,328 entitled "IMPROVEMENTS TO COLOR FLAT PANEL DISPLAY SUB-PIXEL ARRANGEMENTS AND LAYOUTS WITH REDUCED BLUE LUMINANCE WELL VISIBILITY," filed Oct. 22, 2002, and published as US Patent Application Publication 2003/0117423 ("the '423 applicaton"); (6) U.S. patent application Ser. No. 10/278,393 entitled "COLOR DISPLAY HAVING HORIZONTAL SUB-PIXEL ARRANGEMENTS AND LAYOUTS," filed Oct. 22, 2002, and published as US Patent Application Publication 2003/0090581 ("the '581 application"); (7) U.S. patent application Ser. No. 10/347,001 entitled "IMPROVED SUB-PIXEL ARRANGEMENTS FOR STRIPED DISPLAYS AND METHODS AND SYSTEMS FOR SUB-PIXEL RENDERING SAME," filed Jan. 16, 2003, and published as US Patent Application Publication 2004/0080479 ("the '479 application"); each of which is herein incorporated by reference in its entirety, novel sub-pixel arrangements are disclosed for improving the cost/performance curves for image display devices.

These improvements are particularly pronounced when coupled with sub-pixel rendering (SPR) systems and methods further disclosed in those applications and in commonly owned United States Patent Applications: (1) U.S. patent application Ser. No. 10/051,612 entitled "CONVERSION OF A SUB-PIXEL FORMAT DATA TO ANOTHER SUB-PIXEL DATA FORMAT," filed Jan. 16, 2002, and published as US Patent Application Publication 2003/0034992 ("the '992 application"); (2) U.S. patent application Ser. No. 10/150,355 entitled "METHODS AND SYSTEMS FOR SUB-PIXEL RENDERING WITH GAMMA ADJUSTMENT," filed May 17, 2002, and published as US Patent Application Publication 2003/0103058 ("the '058 application"); (3) U.S. patent application Ser. No. 10/215,843 entitled "METHODS AND SYSTEMS FOR SUB-PIXEL RENDERING WITH ADAPTIVE FILTERING," filed Aug. 8, 2002, and published as US Patent Application Publication 2003/0085906 ("the '906 application"); (4) U.S. patent application Ser. No. 10/379,767 entitled "SYSTEMS AND METHODS FOR TEMPORAL SUB-PIXEL RENDERING OF IMAGE DATA" filed Mar. 4, 2003, and published as US Patent Application Publication 2004/0196302 ("the '302 application"); (5) U.S. patent application Ser. No. 10/379,765 entitled "SYSTEMS AND METHODS FOR MOTION ADAPTIVE FILTERING," filed Mar. 4, 2003, and published as US Patent Application Publication 2004/0174380 ("the '380 application"); (6) U.S. patent application Ser. No. 10/379,766 entitled "SUB-PIXEL RENDERING SYSTEM AND METHOD FOR IMPROVED DISPLAY VIEWING ANGLES" filed Mar. 4, 2003, and issued as U.S. Pat. No. 6,917,368 ("the '368 Patent"); (7) U.S. patent application Ser. No. 10/409,413 entitled "IMAGE DATA SET WITH EMBEDDED PRE-SUBPIXEL RENDERED IMAGE" filed Apr. 7, 2003, and published as US Patent Application Publication 2004/0196297 ("the '297 application"); which are hereby incorporated herein by reference in their entirety.

BRIEF DESCRIPTION OF THE DRAWINGS

The accompanying drawings, which are incorporated in, and constitute a part of this specification, illustrate exemplary implementations and embodiments of the invention and, together with the description, serve to explain principles of the invention.

FIG. 4 depicts the phase relationships for the multiple driver chips of FIG. 3.

DETAILED DESCRIPTION

Reference will now be made in detail to implementations and embodiments, examples of which are illustrated in the accompanying drawings. Wherever possible, the same reference numbers will be used throughout the drawings to refer to the same or like parts.

Figure 1A:
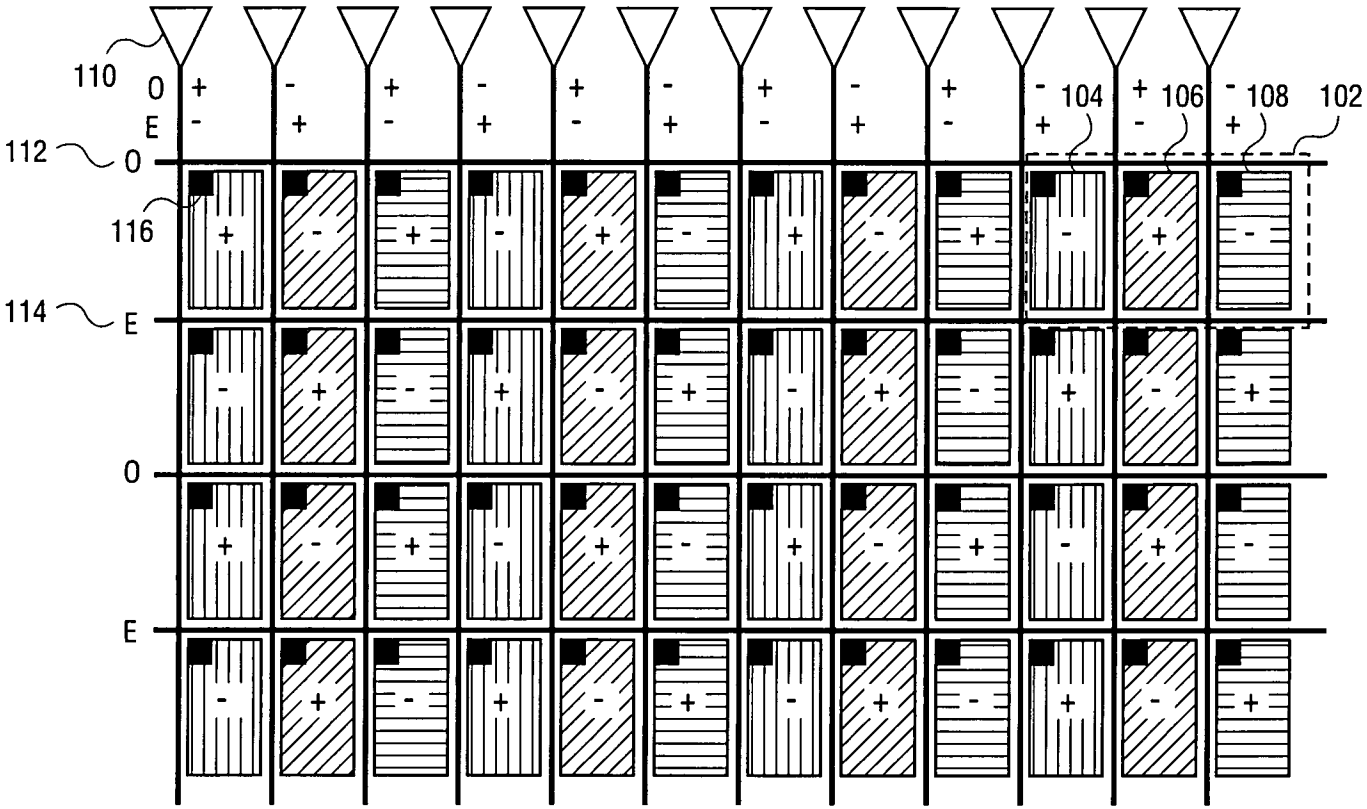
FIG. 1A (PRIOR ART)
FIG. 1A shows a conventional RGB stripe panel having a 1×1 dot inversion scheme.

FIG. 1A shows a conventional RGB stripe structure on panel 100 for an Active Matrix Liquid Crystal Display (AMLCD) having thin film transistors (TFTs) 116 to activate individual colored subpixels—red 104, green 106 and blue 108 subpixels respectively. As may be seen, a red, a green and a blue subpixel form a repeating group of subpixels 102 that comprise the panel.

As also shown, each subpixel is connected to a column line (each driven by a column driver 110) and a row line (e.g. 112 and 114). In the field of AMLCD panels, it is known to drive the panel with a dot inversion scheme to reduce crosstalk or flicker. FIG. 1A depicts one particular dot inversion scheme—i.e. 1×1 dot inversion—that is indicated by a "+" and a "−" polarity given in the center of each subpixel. Each row line is typically connected to a gate (not shown in FIG. 1A) of TFT 116. Image data—delivered via the column lines—are typically connected to the source of each TFT. Image data is written to the panel a row at a time and is given a polarity bias scheme as indicated herein as either ODD ("O") or EVEN ("E") schemes. As shown, row 112 is being written with ODD polarity scheme at a given time while row 114 is being written with EVEN polarity scheme at a next time. The polarities alternate ODD and EVEN schemes a row at a time in this 1×1 dot inversion scheme.

Figure 1B:
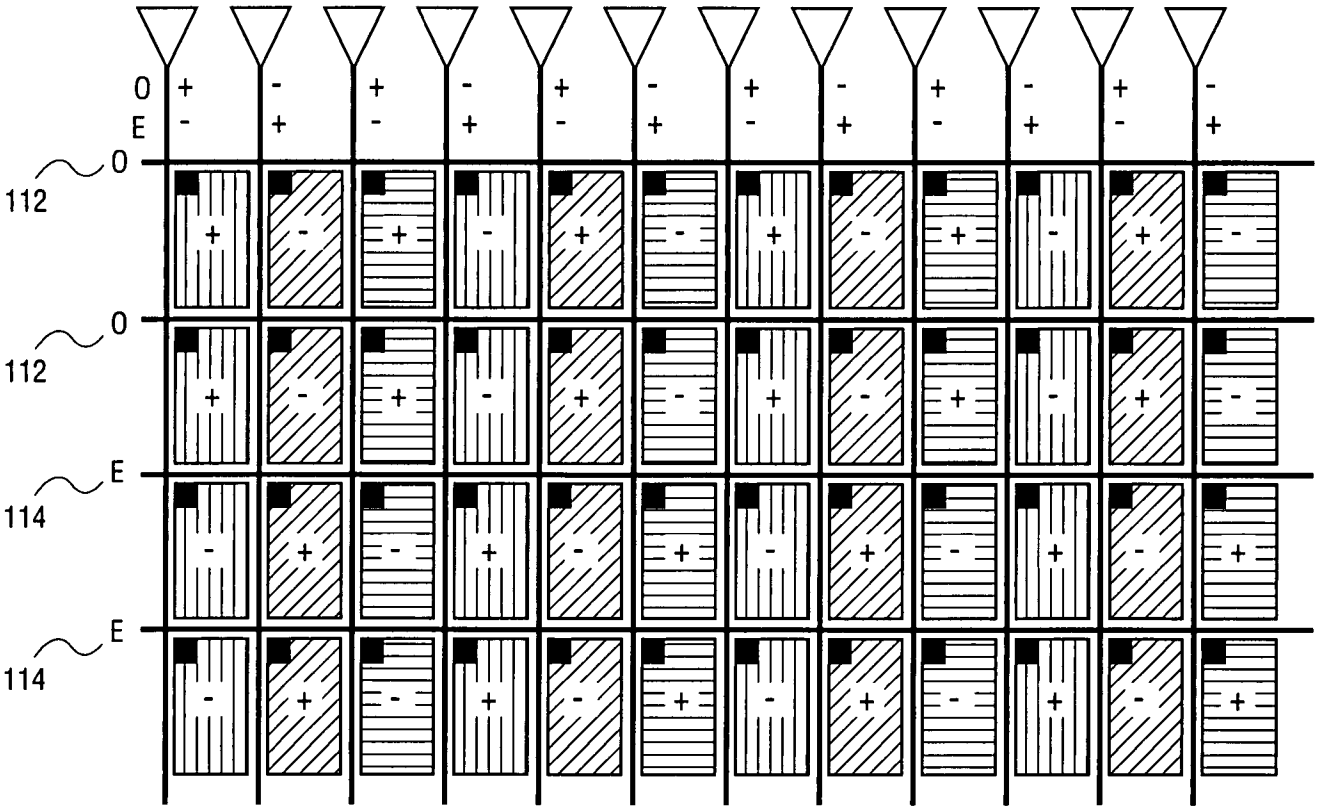
FIG. 1B (PRIOR ART)
FIG. 1B shows a conventional RGB stripe panel having a 1×2 dot inversion scheme.

FIG. 1B depicts another conventional RGB stripe panel having another dot inversion scheme—i.e. 1×2 dot inversion. Here, the polarity scheme changes over the course of two rows—as opposed to every row, as in 1×1 dot inversion. In both dot inversion schemes, a few observations are noted: (1) in 1×1 dot inversion, every two physically adjacent subpixels (in both the horizontal and vertical direction) are of different polarity; (2) in 1×2 dot inversion, every two physically adjacent subpixels in the horizontal direction are of different polarity; (3) across any given row, each successive colored subpixel has an opposite polarity to its neighbor. Thus, for example, two successive red subpixels along a row will be either (+,−) or (−,+). Of course, in 1×1 dot inversion, two successive red subpixels along a column will have opposite polarity; whereas in 1×2 dot inversion, each group of two successive red subpixels will have opposite polarity. This changing of polarity decreases noticeable visual effects that occur with particular images rendered upon an AMLCD panel.

Figure 2:
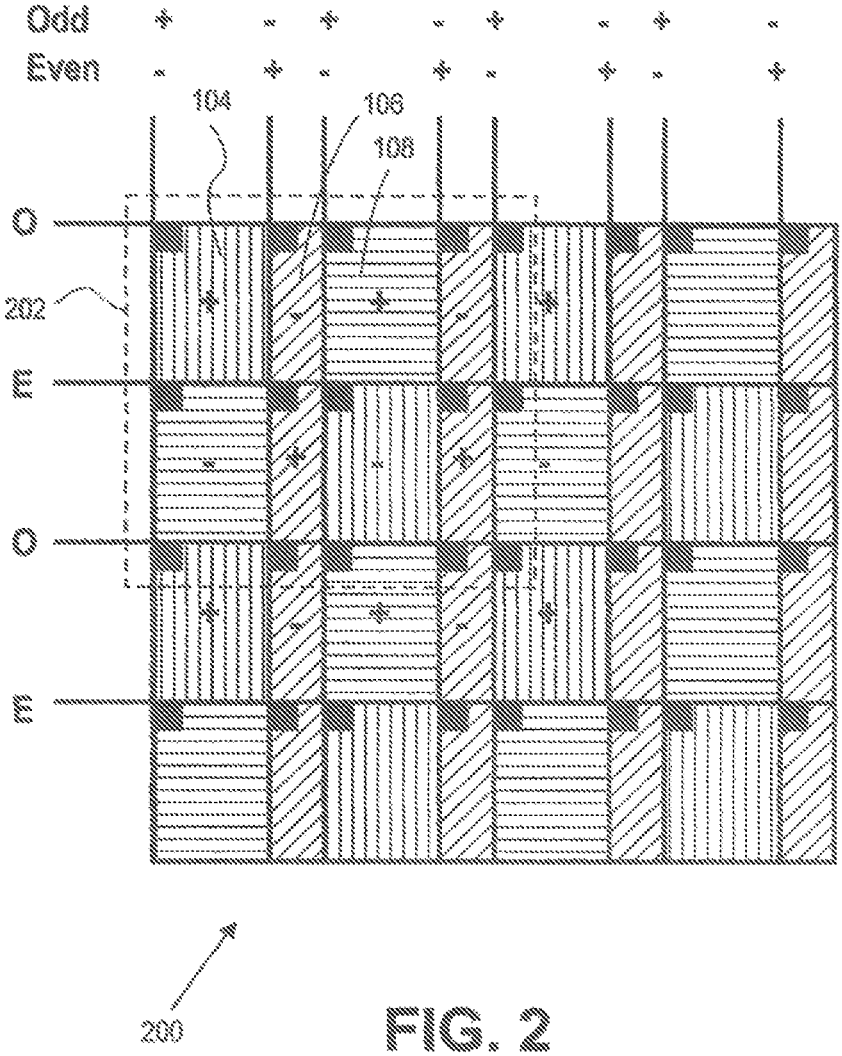
FIG. 2 shows a panel having a novel subpixel repeating group with an even number of pixels in a first (row) direction.

FIG. 2 shows a panel comprising a repeat subpixel grouping 202, as further described in the '225 application. As may be seen, repeat subpixel grouping 202 is an eight subpixel repeat group, comprising a checkerboard of red and blue subpixels with two columns of reduced-area green subpixels in between. If the standard 1×1 dot inversion scheme is applied to a panel comprising such a repeat grouping (as shown in FIG. 2), then it becomes apparent that the property described above for RGB striped panels (namely, that successive colored pixels in a row and/or column have different polarities) is now violated. This condition may cause a number of visual defects noticed on the panel—particularly when certain image patterns are displayed. This observation also occurs with other novel subpixel repeat grouping—for example, the subpixel repeat grouping in FIG. 1 of the '179 application—and other repeat groupings that are not an odd number of repeating subpixels across a row. Thus, as the traditional RGB striped panels have three such repeating subpixels in its repeat group (namely, R, G and B), these traditional panels do not necessarily violate the above noted conditions. However, the repeat grouping of FIG. 2 in the present application has four (i.e. an even number) of subpixels in its repeat group across a row (e.g. R, G, B, and G). It will be appreciated that the embodiments described herein are equally applicable to all such even modulus repeat groupings.

To prevent visual degradation and other problems within AMLCDs, not only must the polarity of data line transitions be randomized along each select line, but the polarity of data line transitions must also be randomized also for each color and locality within the display. While this randomization occurs naturally with RGB triplet color sub-pixels in combination with commonly-used alternate column-inversion data driver systems, this is harder to accomplish when an even-number of sub-pixels are employed along row lines.

In one even modulo design embodiment, rows are formed from a combination of smaller green pixels and less-numerous-but-larger red and blue pixels. Normally, the polarity of data line transitions is reversed on alternate data lines so that each pixel is capacitively coupled about equally to the data lines on either side of it. This way, these capacitor-induced transient errors are about equal and opposite and tend to cancel one another out on the pixel itself. However in this case, the polarity of same-color subpixels is the same and image degradation can occur.

Figure 3:
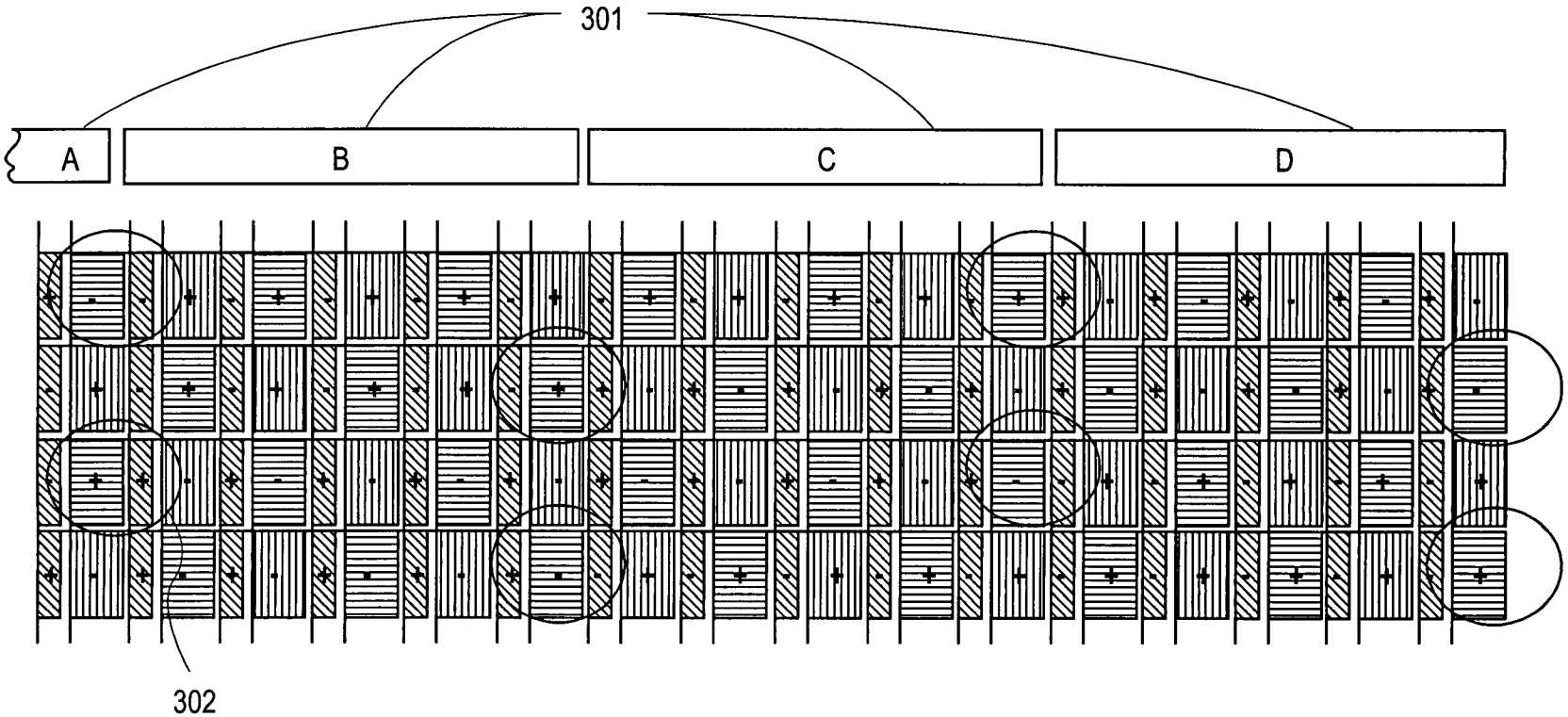
FIG. 3 depicts a panel having the repeating grouping of FIG. 2 with multiple standard driver chips wherein any degradation of the image is placed onto the blue subpixels.

FIG. 3 shows an even modulo pixel layout which utilizes 2×1 dot inversion. Vertical image degradation is eliminated since same color subpixels alternate in polarity. Horizontal image degradation due to same-color subpixels is reduced by changing the phase of the dot inversion periodically. Driver chips 301A through D provide data to the display; the driver outputs are driven +,−,+,−, . . . or −,+,−,+, . . . . The phasing of the polarity is shown in FIG. 4 for the first 4 lines of the display. For example, the first column of chip 301B has the phase −,−,+,+, . . . .

In one embodiment, a subpixel—bordered on either side by column lines driving the same polarity at a given time—may suffer a decreased luminance for any given image signal. So, two goals are to reduce the number of effected subpixels—and to reduce the image degradation effects of any particular subpixel that cannot avoid having been so impacted. Several techniques in this application and in other related applications incorporated herein are designed to minimize both the number and the effects of image degraded subpixels.

One such technique is to choose which subpixels are to be degraded, if degradation may not be avoided. In FIG. 3, the phasing is designed so as to localize the same-polarity occurrence on the circled blue subpixels 302. In this manner, the polarity of same color subpixels along a row is inverted every two driver chips, which will minimize or eliminate the horizontal image degradation. The periodic circled blue subpixels 302 will be slightly darker (i.e for normally-black LCD) or lighter (i.e. for normally-white LCD) than other blue subpixels in the array, but since the eye is not as sensitive to blue luminance changes, the difference should be substantially less visible.

Yet another technique is to add a correction signal to any effected subpixels. If it is known which subpixels are going to have image degradation, then it is possible to add a correction signal to the image data signal. For example, most of the parasitic capacitance mentioned in this and other applications tend to lower the amount of luminance for effected subpixels. It is possible to heuristically or empirically determine (e.g. by testing patterns on particular panels) the performance characteristics of subpixels upon the panel and add back a signal to correct for the degradation. In particular to FIG. 3, if it is desired to correct the small error on the circled pixels, then a correction term can be added to the data for the circled blue subpixels.

Figure 5:
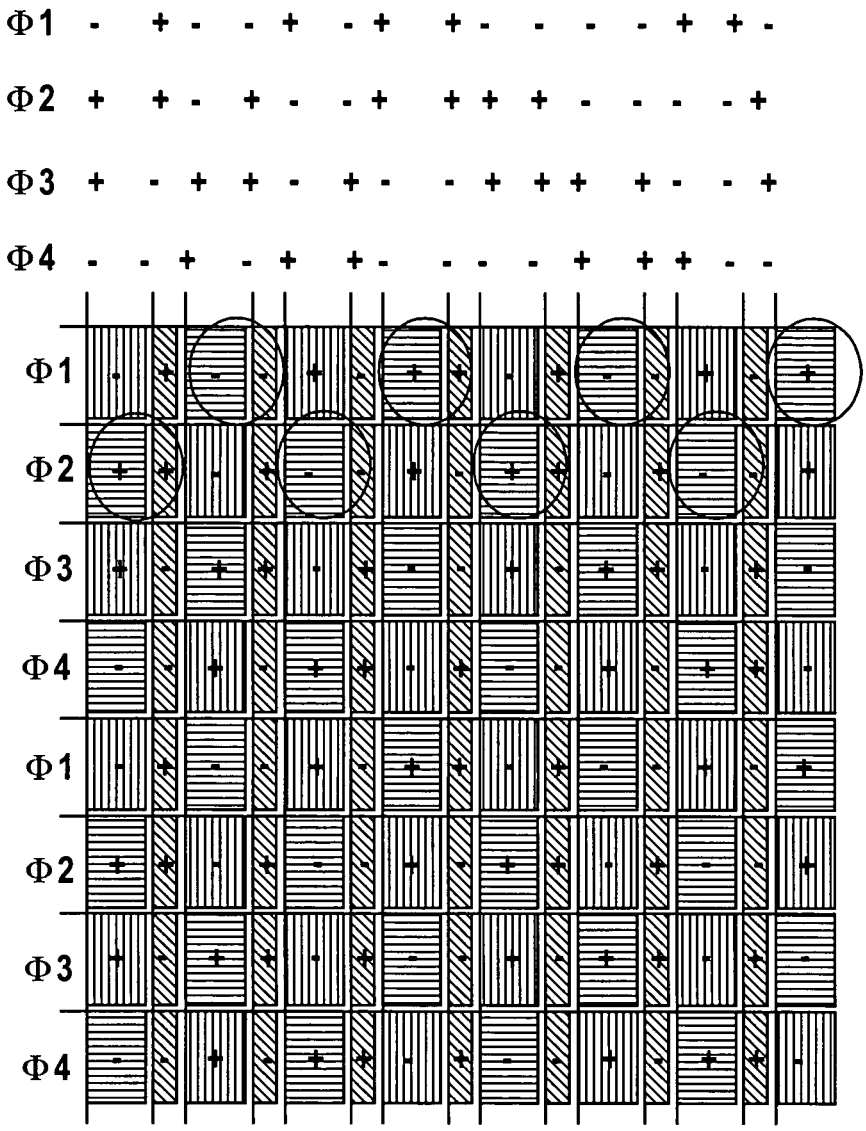
FIG. 5 depicts a panel having the subpixel repeating group of FIG. 2 wherein the driver chip driving the panel is a 4-phase chip wherein any degradation of the image is placed onto the blue subpixels.

In yet another embodiment of the present invention, it is possible to design different driver chips that will further abate the effects of image degradation. As shown in FIG. 5, a four-phase clock, for example, is used for polarity inversion. By the use of this pattern, or patterns similar, only the blue subpixels in the array will have the same-polarity degradation. However, since all pixels are equally degraded, it will be substantially less visible to the human eye. If desired, a correction signal can be applied to compensate for the darker or lighter blue subpixels.

These drive waveforms can be generated with a data driver chip that provides for a more complex power-supply switching system than employed in the relatively simple alternate polarity reversal designs. In this two-stage data driver design, the analog signals are generated as they are done now in the first stage. However, the polarity-switching stage is driven with its own cross-connection matrix in the second stage of the data driver to provide the more complex polarity inversions indicated.

Yet another embodiment of the techniques described herein is to localize the image degradation effect on a subset of blue subpixels across the panel in both the row and column directions. For example, a "checkerboard" of blue subpixels (i.e. skipping every other blue subpixel in either the row and/or column direction) might be used to localize the image degradation signal. As noted above, the human eye—with its decreased sensitivity in blue color spatial resolution—will be less likely to notice the error. It will be appreciated that other subsets of blue subpixels could be chosen to localize the error. Additionally, a different driver chip with four or fewer phases might be possible to drive such a panel.

Figure 6:
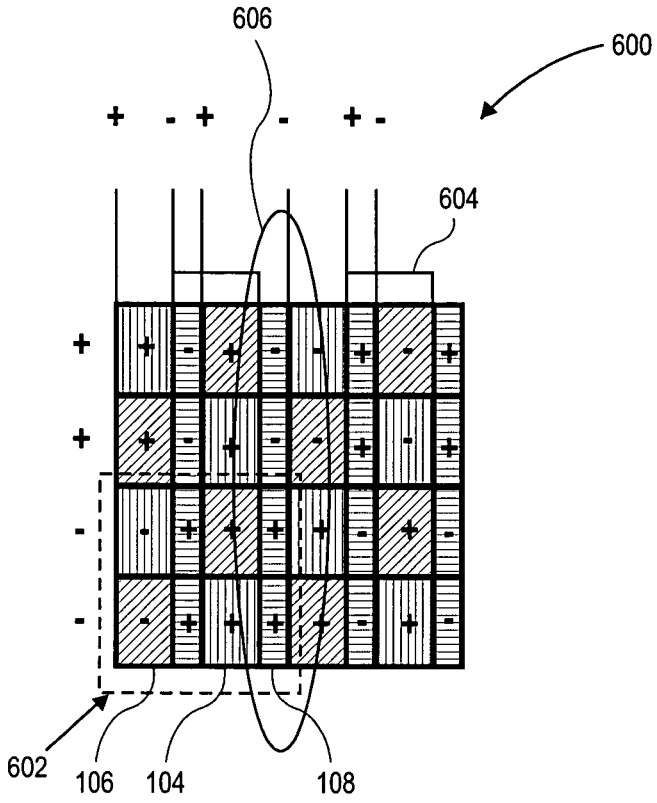
FIG. 6 depicts a panel having a subpixel repeating group having two narrow columns of blue subpixels wherein substantially all or most of the degradation of the image is placed onto the narrow blue subpixel columns.

FIG. 6 is yet another embodiment of a panel 600 comprised substantially of a subpixel repeating group 602 of even modulo. In this case, group 602 is comprised of a checkerboard of red 104 and green 106 subpixels interspersed with two columns of blue 108 subpixels. It should be appreciated that while FIG. 6 depicts the blue subpixel as narrower than either the red or the green subpixels, another embodiment employs blue subpixels of equal area dimensions to the red and green subpixels. To achieve a pleasing white point with all subpixels on in a logical pixel, the relative intensities of the red, green and blue subpixels can be changed appropriately as discussed in commonly assigned U.S. patent application Ser. No. 10/243,094, entitled "FOUR COLOR ARRANGEMENTS OF EMITTERS FOR SUB-PIXEL RENDERING," filed Sep. 13, 2002, published as US 2004/0051724.

Figure 7A:
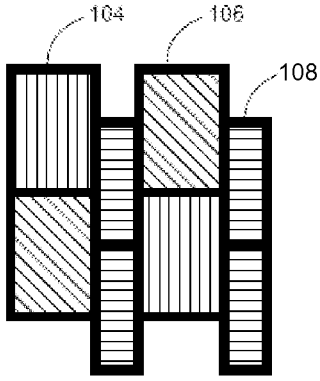
FIGS. 7A and 7B show other embodiments of the octal subpixel arrangement of FIG. 6 with various vertical displacements of the subpixels.
Figure 7B:
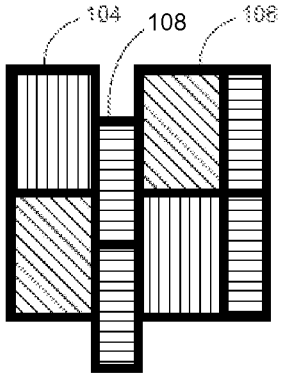

As shown in FIG. 6, the subpixels appear to have a substantially rectangular appearance. It should be appreciated that subpixels having other shapes are also possible. For example, a multitude of other regular or irregular shapes for the subpixels are possible and are desirable if manufacturable. As subpixel shapes may vary, so too may the positions of the subpixels be varied. For example, FIGS. 7A and 7B depict a similar octal subpixel grouping wherein one or both of the majority stripes 108 are offset (relatively or otherwise) from the other subpixels 104 and 106. Other vertical offsets are also possible.

Yet other embodiments are also possible. For example, the entire octal subpixel grouping may be rotated 90 degrees to reverse the roles of row and column driver connections to the grouping. Such a horizontal arrangement for subpixels is further disclosed in the co-pending and commonly assigned application U.S. Ser. No. 10/278,393 entitled "COLOR DISPLAY HAVING HORIZONTAL SUB-PIXEL ARRANGEMENTS AND LAYOUTS" published as US 2003/0090581.

As may be seen in FIG. 6, two neighboring columns of blue subpixels may share a same column driver through an interconnect 604, possibly with the TFTs of the blue subpixels appropriately remapped to avoid exact data value sharing.

With standard column drivers performing 2×1 dot inversion, it can be seen that blue subpixel column 606 has the same polarity as the column of red and green subpixels to its immediate right. Although this may induce image degradation (which may be compensated for with some correction signal), it is advantageous that the degradation is localized on the dark colored (e.g. blue) subpixel column; and, hence, less visible to the human eye.

What is claimed is:

1. A liquid crystal display comprising:

a panel substantially tessellated by a subpixel repeating group comprising differently colored subpixels and having an even number of subpixels including a first colored subpixel, a second colored subpixel, a third colored subpixel and a fourth colored subpixel, which first through fourth colored subpixels are consecutively arranged in a row wherein the first, second and fourth subpixels have different colors from each other while the third colored subpixel has a same color as that of the first colored subpixel, said subpixel repeating group defining a first column of same colored subpixels, where the color of said same colored subpixels of the first column is same as the first colored subpixel; and a driver circuit configured for sending to the panel, image signals representing image data;

wherein said driver circuit is configured to use a substantially periodic dot inversion polarity scheme, which scheme includes a violation of the periodicity of the dot inversion polarity scheme, the violation being defined by presence of consecutively adjacent subpixels to each other that are disposed in a same row and are driven by signals having a same polarity, the violation being localized at one or more of the columns of first colored subpixels such that potential image degradation introduced by the violation of the otherwise periodic dot inversion polarity scheme is localized on said one or more of the columns of first colored subpixels.

2. The liquid crystal display of claim 1 wherein the same color of the defined first column is a blue color.

3. The liquid crystal display of claim 1 wherein said subpixel repeating group substantially defines a checkerboard of red and green subpixels interspersed with two columns of blue subpixels.

4. The liquid crystal display of claim 3 wherein for each said subpixel repeating group said two columns of blue subpixels share a same column data driver.

5. The liquid crystal display of claim 1, wherein a correction signal is applied to one or more of the subpixels at which the violation of the periodic dot inversion polarity scheme occurs and the applied a correction signal counters a loss of luminance caused by the violation.

6. A method of providing a substantially periodic dot inversion polarity scheme in a liquid crystal display having a panel that is substantially tessellated by a primitive subpixel repeating group comprising differently colored subpixels disposed to define rows and columns within the primitive subpixel repeating group where each row has an even number of subpixels including a first colored subpixel, a second colored subpixel, a third colored subpixel and a fourth colored subpixel, which first through fourth colored subpixels are consecutively arranged in a row of the primitive subpixel repeating group, wherein the first, second and fourth subpixels have different colors from each other while the third colored subpixel has a same color as that of the first colored subpixel, said subpixel repeating group further defining as one of its columns, a first column of same colored subpixels where the color of said same colored subpixels of the first column is same as the first colored subpixel, the method comprising:

providing driver signals to the subpixels in the panel, wherein said providing of the driver signals uses a substantially periodic dot inversion polarity scheme, which includes a violation, the violation being defined by presence of consecutively adjacent subpixels to each other that are disposed in a same row and are driven by signals having a same polarity, the violation being localized at one or more of the columns of first colored subpixels such that potential image degradation introduced by the periodic dot inversion polarity scheme is localized on the column of first colored subpixels.

7. The method of claim 6, wherein the column of first colored subpixels is a column of blue subpixels.

8. The method of claim 6, wherein the subpixel repeating group is characterized by a checkerboard of red and green subpixels interspersed with two columns of blue subpixels.

9. The method of claim 8, wherein for each subpixel repeating group the providing driver signals includes providing of scheme violating signals to the two columns of blue subpixels from a same column driver.

10. The method of claim 6, further comprising: providing correction signals to one or more subpixels in the group of subpixels at which the violation of the periodic dot inversion polarity scheme occurs, where the provided correction signals counter loss of luminance caused by the violation.

11. A method of providing a substantially periodic dot inversion polarity scheme in a liquid crystal display having a panel that is substantially tessellated by a primitive subpixel repeating group comprising differently colored subpixels disposed to define rows and columns within the primitive subpixel repeating group where each row has an even number of subpixels including a first colored subpixel, a second colored subpixel, a third colored subpixel and a fourth colored subpixel, which first through fourth colored subpixels are consecutively arranged in a row of the primitive subpixel repeating group, wherein the first, second and fourth subpixels have different colors from each other while the third colored subpixel has a same color as that of the first colored subpixel, said subpixel repeating group further defining as one of its columns, a first column of same colored blue subpixels; and the method comprising:

providing signals for image data having a substantially periodic dot inversion polarity scheme, which includes a violation in a row direction, to the panel such that potential image degradation introduced by the periodic dot inversion polarity scheme is localized on column of blue subpixels.

12. The method of claim 11, further comprising providing a correction signal to one or more subpixels.

13. A liquid crystal display, comprising:

a display panel including a plurality of subpixels arranged to define a primitive subpixel repeating group having rows and columns; each row of said subpixel repeating group having an even number of subpixels including a first colored subpixel, a second colored subpixel, a third colored subpixel and a fourth colored subpixel, which first through fourth colored subpixels are consecutively arranged in a row of the primitive subpixel repeating group, wherein the first, second and fourth subpixels have different colors from each other, and where the primitive subpixel repeating group defines as one of its columns, a column of dark colored subpixels; and means for providing driver signals to the subpixels in the display panel to send image data having a substantially periodic dot inversion polarity scheme, which substantially periodic scheme includes a violation of the periodicity of the dot inversion polarity scheme, the violation being defined by occurrence of consecutively adjacent subpixels to each other that are disposed in a same row and are driven by signals having a same polarity, the violation being localized such that image degradation introduced by the periodicity violating driver signals is localized on the column of dark colored subpixels.

14. The liquid crystal display of claim 13, wherein the column of dark colored subpixels is a column of blue subpixels.

15. The liquid crystal display of claim 13, wherein said subpixel repeating group defines a checkerboard of red and green subpixels interspersed with two columns of blue subpixels.

16. The liquid crystal display of claim 15, wherein said means for providing driver signals provides signals to the two columns of blue subpixels from a same column driver.

17. The liquid crystal display of claim 13, further comprising:

means for providing correction signals to one or more subpixels in the group of subpixels.

18. A liquid crystal display, comprising:

display means including a plurality of subpixels arranged in accordance with a panel tessellating subpixel repeating group, the subpixel repeating group being characterized by an even number of subpixels including a first colored subpixel, a second colored subpixel, a third colored subpixel and a fourth colored subpixel, which first through fourth colored subpixels are consecutively arranged in a row of the subpixel repeating group, wherein the first, second and fourth subpixels have different colors from each other while the third colored subpixel has a same color as that of the first colored subpixel, and wherein the subpixel repeating group further defines at least one column of blue subpixels; and driving means for providing signals for image data having a substantially periodic dot inversion polarity scheme, which substantially periodic scheme includes a violation of the periodicity of the dot inversion polarity scheme, the violation being defined by consecutively adjacent subpixels being disposed in a same row and being driven by signals having a same polarity, the violation being localized to preselected parts of the corresponding row, the signals being provided to the display means; said driving means having at least two phases selected such that potential image degradation introduced by the localized violation of the periodicity of the dot inversion polarity scheme is placed substantially upon the at least one column of blue subpixels.

19. The liquid crystal display of claim 18, further comprising:

means for providing a correction signal to one or more subpixels.

20. The method of claim 11, wherein the said use of a driver circuit comprises providing a plurality of two-phase driver chips for driving respective bounded sections of the display; and wherein phases of each provided driver chip are selected such that parasitic effects placed upon imagery of any of the subpixels driven by said phased signals are placed substantially upon subpixels disposed in columns positioned at a boundary of the bounded display sections respectively driven by said driver chips.

21. The liquid crystal display of claim 18, wherein said driving means includes a plurality of two-phase driver chips each for providing signals for the image data having the polarity scheme to respective bounded sections of the display means; the phases of each driver chip being selected such that parasitic effects placed upon imagery of any of the subpixels driven by said signals are placed substantially upon blue subpixels disposed in columns positioned at a boundary of the bounded display sections respectively driven by said driver chips.

22. The liquid crystal display of claim 1 wherein said driver circuit sends signals indicating image data having a polarity scheme to the panel such that at least two adjacent subpixels in a row have the same polarity.

23. The liquid crystal display of claim 13 wherein said means for providing driver signals includes a plurality of two-phase driver chips for sending said driver signals to the display panel; the phases of each driver chip being selected such that scheme violations introduced by said driver signals are placed substantially upon blue subpixels disposed in columns positioned at a boundary between said driver chips.

24. The liquid crystal display of claim 1, wherein the image degradation is caused by same-color subpixels of same polarity occurring successively one after the next.

25. The liquid crystal display of claim 11, wherein the violation tends to cause image degradation due to parasitic effects of parasitic capacitances present in the panel.

* * * * *